US006212749B1

(12) United States Patent
Chow et al.

(10) Patent No.: US 6,212,749 B1
(45) Date of Patent: Apr. 10, 2001

(54) MOUNT ASSEMBLY SYSTEM

(75) Inventors: E. Allan Chow, West Bloomfield; Thomas R. Lauro, Sterling Heights, both of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/385,855

(22) Filed: Aug. 30, 1999

(51) Int. Cl.[7] ..... B25B 27/14
(52) U.S. Cl. ..... 29/281.5; 29/271; 269/37
(58) Field of Search ..... 296/35.1; 29/281.5, 29/271; 269/37

(56) References Cited

U.S. PATENT DOCUMENTS 5,409,283 * 4/1995 Ban ..... 296/35.1
5,775,666 * 7/1998 Tsukamoto et al. ..... 248/634

* cited by examiner

*Primary Examiner*—Robert C. Watson
(74) *Attorney, Agent, or Firm*—Jeffrey A. Sedlar

(57) ABSTRACT

A mount assembly system provides repeatable net position of vehicle body mounts, enabling an automated body to frame marriage process. With the system, a body mount bracket is assembled to the vehicle's frame rail and the body mount is relocatably attached thereto. Prior to tightening the mount, a positioning fixture engages the mount, repositioning it to a desired location.

9 Claims, 7 Drawing Sheets

MOUNT ASSEMBLY SYSTEM

TECHNICAL FIELD

The present invention relates to a mount assembly system and more particularly, to a system for providing repeatable net position of body mounts, facilitating the automation of a vehicle body and frame marriage process.

BACKGROUND OF THE INVENTION

One of the most impressive operations in a vehicle assembly plant involves the marriage of a vehicle body structure to its chassis. Commonly used methodology involves a substantial reliance upon manual intervention to accomplish this complex task. Automating this type of vehicle assembly process is highly desirable due to the labor intensive and physically demanding operations involved. Automation is complicated by factors like the stack-up of build tolerances that occurs as components are assembled together. In the case of body on frame vehicles including medium and heavy duty trucks, a number of unique frame assemblies with different rail spacing widths or different frame rail material properties may be employed for various GVW applications. A desire to marry the resulting variants to a common body design further complicates automation.

During the marriage process, body mounts are commonly manually aligned to enable assembly of the bolts that secure the body to the frame. Attempts at automation of the marriage process have been made by using means such as "post-piercing" of the assembled frame before marriage. This is somewhat of a limited solution since it is rather costly and is not universally employable, especially in vehicles with large ladder-type frames. Accordingly, advances in component design that facilitate marriage automation in a cost-effective manner are needed.

SUMMARY OF THE INVENTION

Aspects of the invention reside in a generic mount assembly system that facilitates the automated marriage of a pair of mating components or assemblies through the interposed mount. Depending on the specific application involved, the intended advantages include: providing repeatable net positioning, avoiding part number proliferation, overcoming build-tolerance stack, and improving operator working conditions. The resultant aspects are achieved through employment of a mount alignment feature that operates to position the mount(s) during their assembly onto one of the to-be-mated components or assemblies.

With more specificity, a mount assembly system includes a first component or assembly with a mount fastened thereto in an initially repositionable manner, wherein the mount moves relative to the component or assembly in concert with a repositioning element. The repositioning element includes a positioning feature that is engageable by a positioning fixture to effect proper alignment to a repeatable net position selected for the later introduction of a second component or assembly that will arrive at a predetermined point in space coinciding with said repeatable net position for marriage of the first and second components or assemblies together.

A preferred exemplary embodiment of the present invention described here as an aid in readily conveying the nature of the invention, enables automated assembly of a truck body to its frame and includes a frame having a pair of brackets on opposed sides thereof. The brackets support the body on the frame, through an interposed body mount. During assembly, the frame and brackets accept a pair of body mounts in a repositionable manner whereupon, a positioning fixture engages the frame and engages repositioning elements of the mounts to align the body mounts, which are then fixed in place on the brackets relative to the frame. In this case the positioning fixture includes a pin as a repositioning effector that engages within positioning orifices that have previously been provided in a fixed position relative to the body mount.

The numbered claims found at the conclusion of this specification particularly and distinctly define the subject matter of the invention per se. As is typical, the claims are presented to cover a range of inventive breadth, and may have evolved through the give-and-take process of patent examination. The preceding summary of the invention is intended to be consistent therewith, and any inconsistencies are to be resolved by giving governing weight to the language of the claims.

BRIEF DESCRIPTION OF THE DRAWINGS

The present invention will now be described by way of example, with reference to the accompanying drawings in which.

DESCRIPTION OF THE PREFERRED EMBODIMENT

Figure 1:
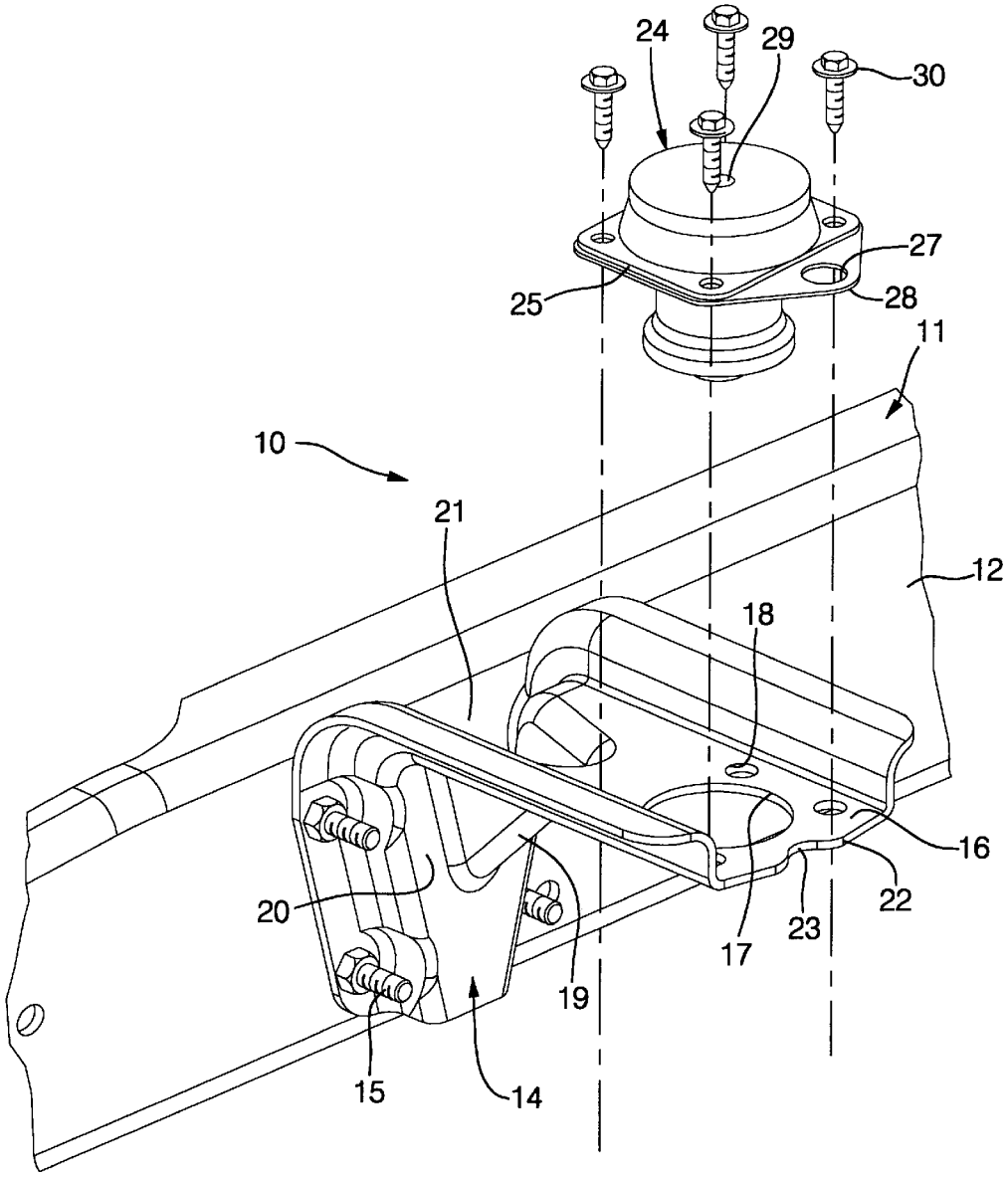
FIG. 1 is a fragmentary perspective view of a mount assembly system according to the present invention, shown partially exploded.

Referring to the drawings, FIG. 1 illustrates one side of a vehicle's mount assembly system 10. The vehicle's frame rail 11 comprises an open-section channel having a substantially vertical wall 12 that supports a body mount bracket 14 through a plurality of fasteners 15. Typically, the spacing width between the vehicle's left and right frame rails and the material thickness used in the rails will be provided in a number of variants chosen for different end uses of the vehicles. Body mount bracket 14 is a metal stamping having typical structural elements for added rigidity and includes a substantially horizontal platform 16 positioned slightly away from the frame rail 11. A rib 19 is formed as one piece with the body mount bracket 14 and extends between the vertical leg 20 and the platform 16 leaving a sizable wedge-shaped void 21 between the body mount bracket 14 and the frame rail 11. The void 21 facilitates the repositioning operation described below. The platform 16 includes a central opening 17 surrounded by a plurality of smaller satellite openings 18, the congregation existing near the terminal end 22 and across the void 21 from the frame rail 11. A notch 23 is formed in terminal end 22, at a position that is outboard from the central opening 17.

A resilient body mount 24 is constructed from metal and an elastomeric material of a specific durometer rating chosen for the application, and includes a generally cylindrically shaped core having a mounting hole 29 extending therethrough. The body mount 24 includes an integral plate 25 with a set of holes 26 spaced to align with the openings 18 of the bracket 14 and being elongated to allow repositioning of the body mount 24 relative to the bracket 14. Additionally, a positioning orifice 27 extends through a lobe 28 of the plate 25 in a position chosen to align with notch 23 of bracket 14 and serves as the positioning feature of a repositioning element in this case. The positioning orifice 27 is optionally provided in a lobe of any substantially rigid component of the body mount 24. The body mount 24 is configured to be fastened to the bracket 14 by a plurality of fasteners 30, which can optionally be integrated into the plate 25. Initially, the body mount 24 is loosely attached to the bracket 14, so that it is movable, and once positioned relative to the outer surface of the rail 11, the fasteners 30 are torqued.

Figure 2:
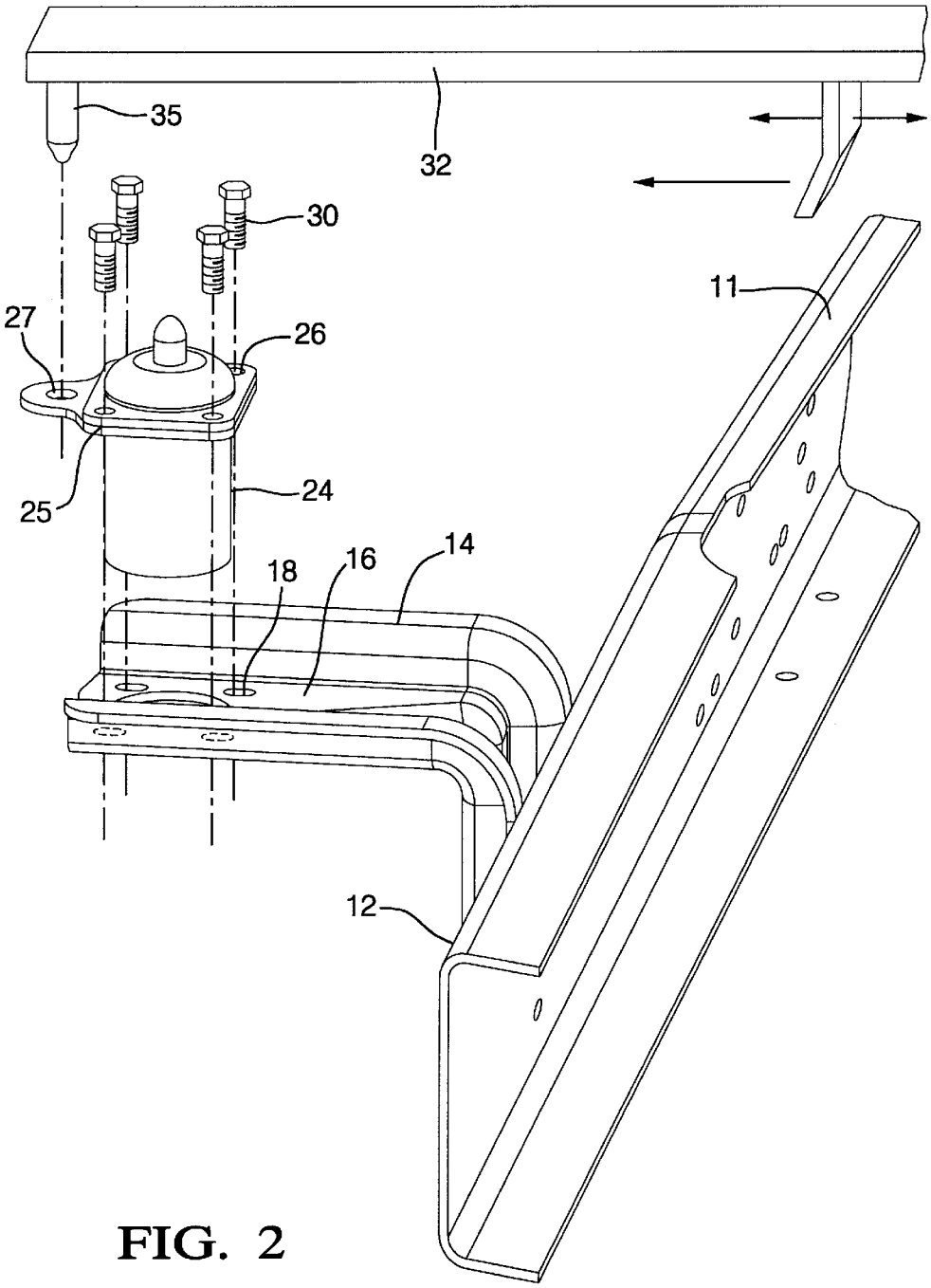
FIG. 2 is a fragmentary perspective view of a mount assembly system according to the present invention, shown partially exploded.

Referring to FIG. 2, further details of the repositioning system are shown. The bracket 14 receives the core of the body mount 24 through the central opening 17 so that the plate 25 rests on the platform 16. The central opening 17 is sized to allow movement of the body mount 24 in the direction of adjustment. The elongated holes 26 align with the openings 18. Initially, the fasteners 30 are loosely threaded into the openings 18 and extend through the holes 26. Positioning fixture 32 includes a repositioning effector in the form of pin 35, and operates to position the body mount 24 before the fasteners 30 are tightened. The positioning fixture 32 includes a depending arm 33 that includes an outwardly tapering segment 34 that operates to help automatically center the fixture relative to the frame rail 11 as it is lowered into engagement therewith. As this occurs, the tapered tip of the pin 35 enters positioning orifice 27 and as the pin in inserted, the taper repositions the body mount 24 to the preferred position relative to the frame rail 11. The arm 33 enters the void 21 formed between the vertical wall 12 and the rib 19. The positioning orifice serves to later receive a drift pin (not shown) which locates the nutrunner when the body mount bolt is torqued, and also performs the final location of the body to the frame.

Figure 3:
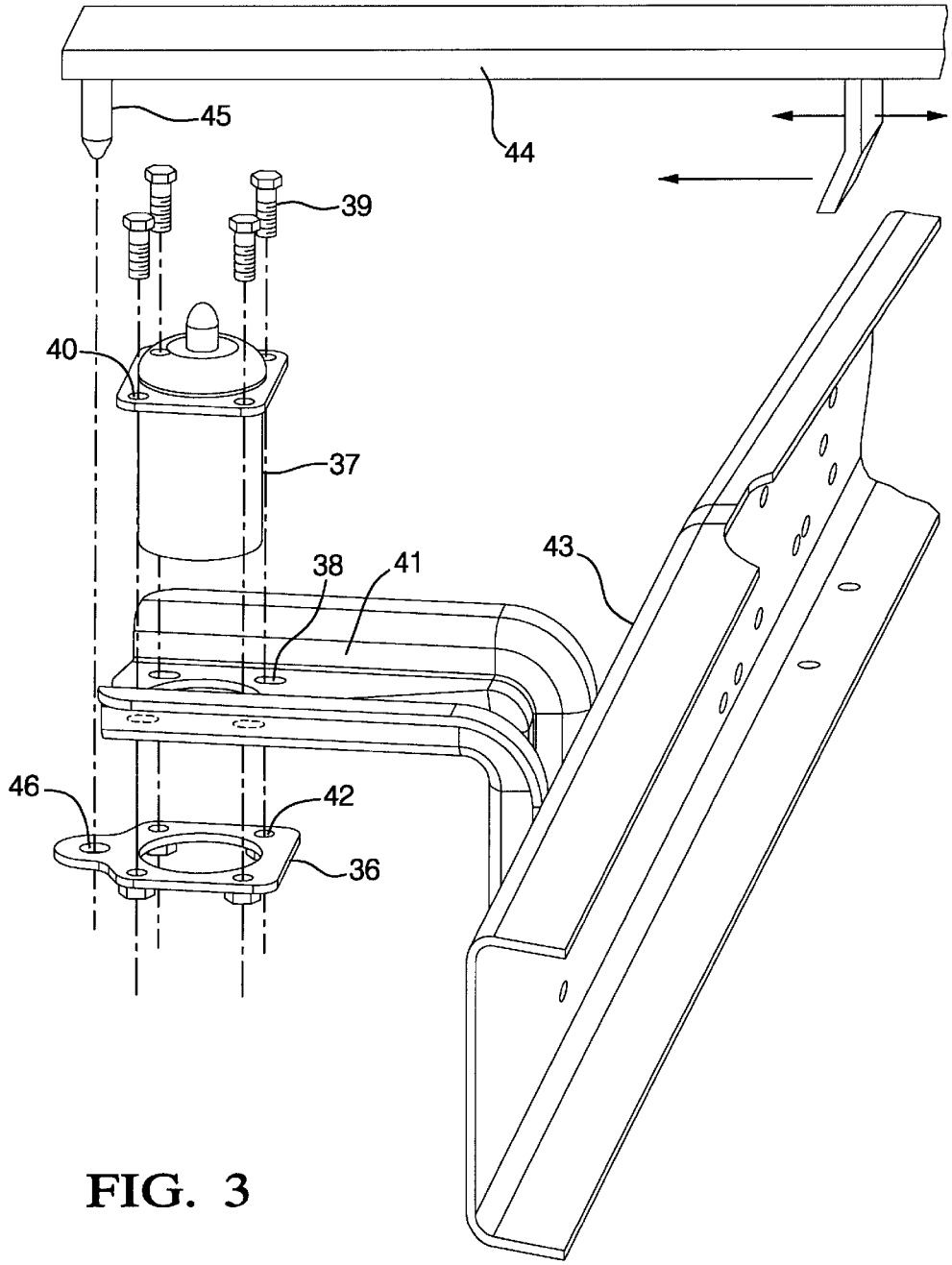
FIG. 3 is a fragmentary perspective view of a mount assembly system according to the present invention, shown partially exploded.

FIG. 3 shows an alternative embodiment of the invention wherein the plate arrives as a separate element from the body mount 37. In this assembly, the openings 38 are elongated and the fasteners 39 extend through openings 40 in the body mount 37, openings 38 in bracket 41, and into openings 42 of plate 36. Elongation of the openings 38 and the central opening 17 permits repositioning of the body mount 40 relative to the frame rail 43. Initially, the body mount is loosely connected to the bracket 41 along with the plate 36 by the fasteners 39. Subsequently, the body mount 37 is repositioned by the positioning fixture 44 by engagement of the pin 45 in the positioning orifice 46. The body mount is subsequently positioned by virtue of a tightly toleranced fit to the plate 36. After the body mount 37 is properly located, the fasteners 39 are tightened.

Figure 4:
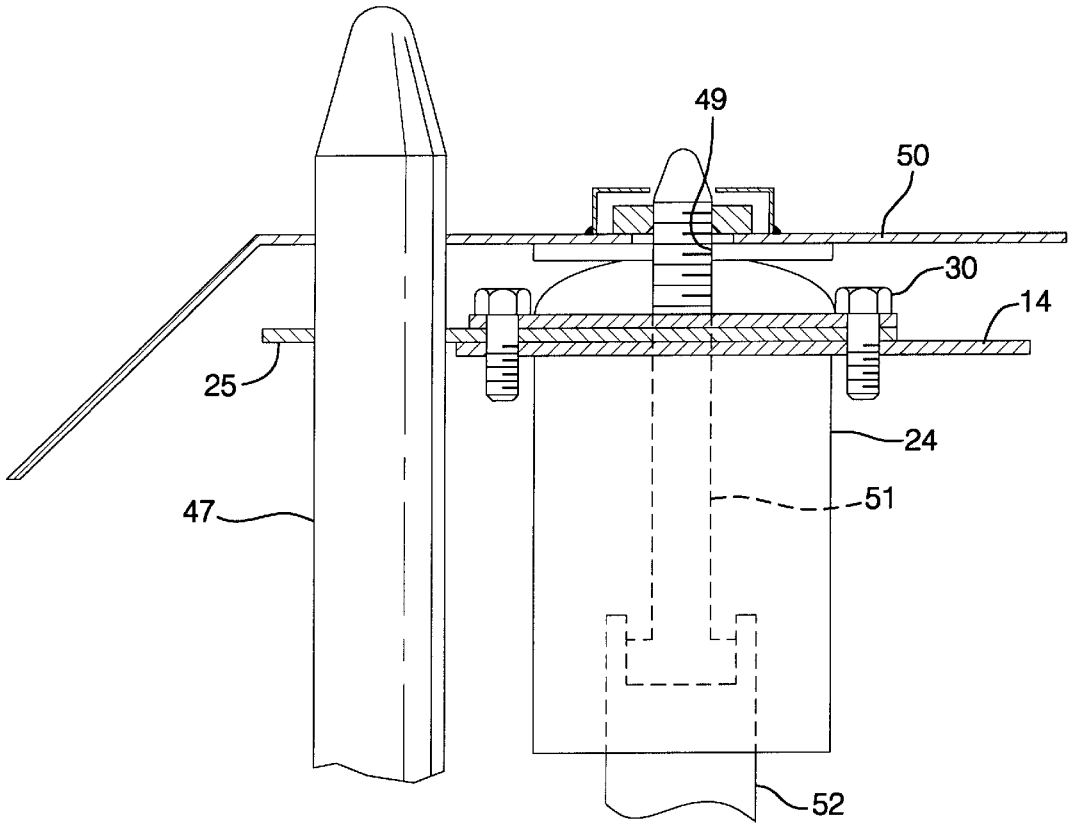
FIG. 4 is a fragmentary cross sectional view of the mount assembly system of FIG. 2.

FIG. 4 illustrates the system of FIG. 1 in an assembled state. The body mount 24 is positioned and fixed to the bracket 14 by the fasteners 30. The vehicle body 50 is attached to the mount 24 by a bolt 51 that extends through the body mount 24 and is threaded into the body 51 by a nutrunner 52. The plate 25 remains a part of the final assembly. A drift pin 47 is also shown, which extends through the opening 46 and into the body 50, locating the body relative to the frame.

Figure 5:
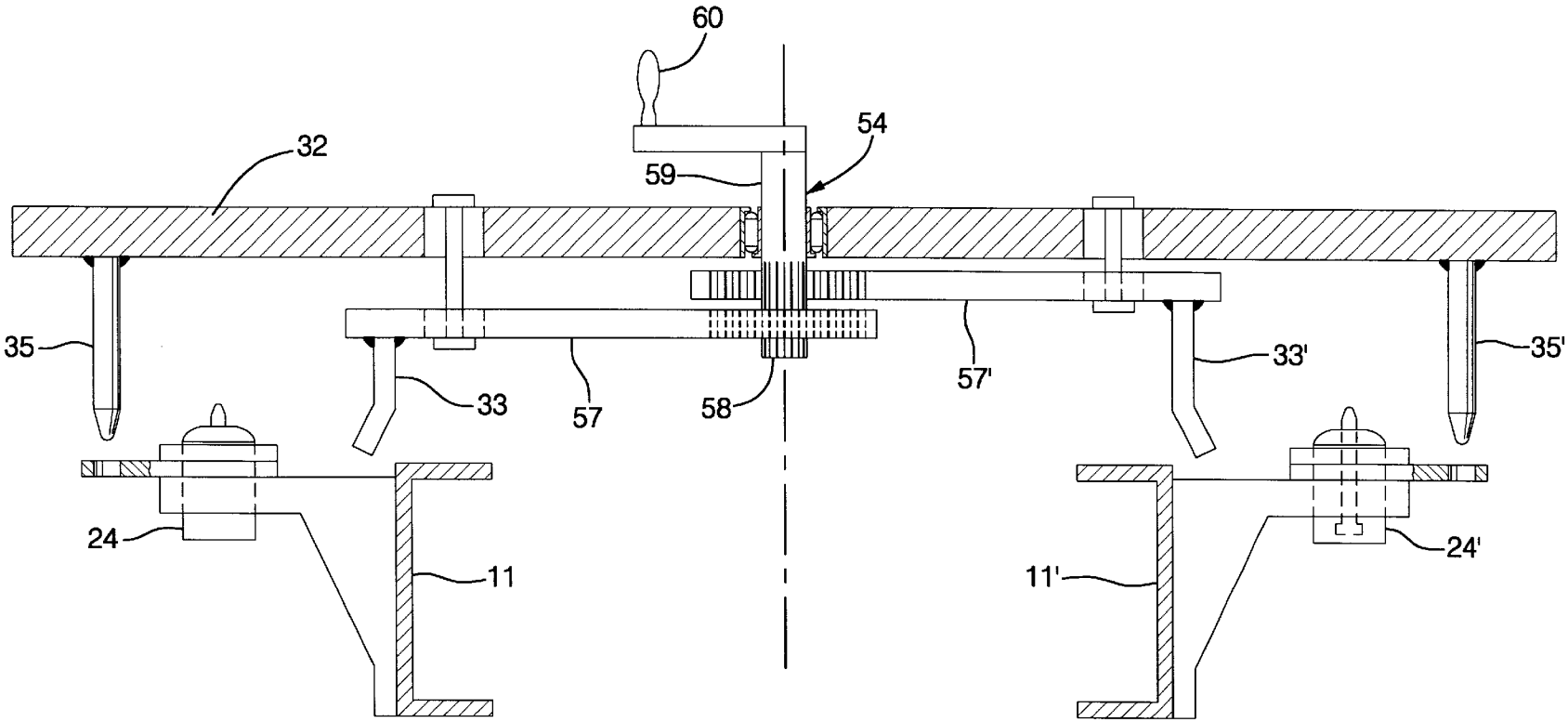
FIG. 5 is a fragmentary cross sectional view of the mount assembly system of FIG. 2 with the positioning fixture in a pre-engagement location.
Figure 6:
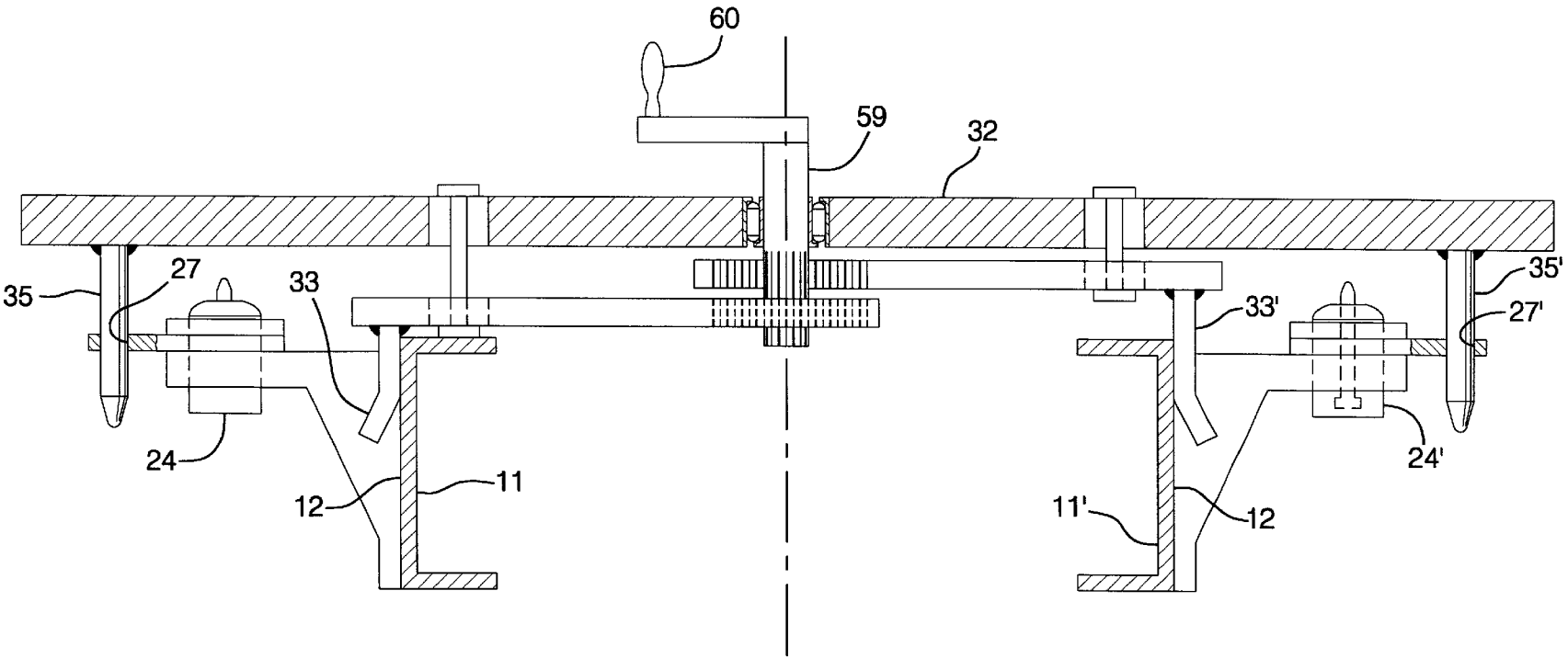
FIG. 6 is a fragmentary cross sectional view of the mount assembly system of FIG. 2 with the positioning fixture in an engagement location.

FIG. 5 shows the positioning fixture 32 in greater detail and discloses that the mounts 24, 24' on both sides of the frame are positioned simultaneously. The locating pins 35, 35' are carried by the positioning fixture at a fixed distance apart from one another, that is selected to effect the placement of the mounts 24, 24' to a position corresponding to the spacing of the mounting holes 49 in the body 50 (as shown in FIG. 4). The pins 35, 35' and as a result, the body mounts 24, 24', are centered relative to the frame rails 11, 11 ' by the centering mechanism 54 of the positioning fixture 32. Centering mechanism 54 includes a pair of arms 33, 33' that are movable in opposing directions and in concert with racks 57 and 57' which are engaged through a pinion 58 of a shaft 59 that is journaled at a fixed point in positioning fixture 32. The shaft 59 includes a rotating mechanism, in this case a hand crank 60. As shown in FIG. 6, when the positioning fixture 32 is lowered onto the rails 11, 11', the pins 35, 35' extend through the positioning orifices 27, 27'. As the shaft 59 is rotated, the arms 33, 33' pull tight against the vertical walls 12, 12' centering the positioning fixture 32 relative to the frame rails 11, 11 ' and positioning the mounts 24, 24'. After positioning, the fasteners are tightened to fix the mounts 24, 24' in position and the positioning fixture 32 is retracted to allow for marriage of the body to the frame.

Figure 7:
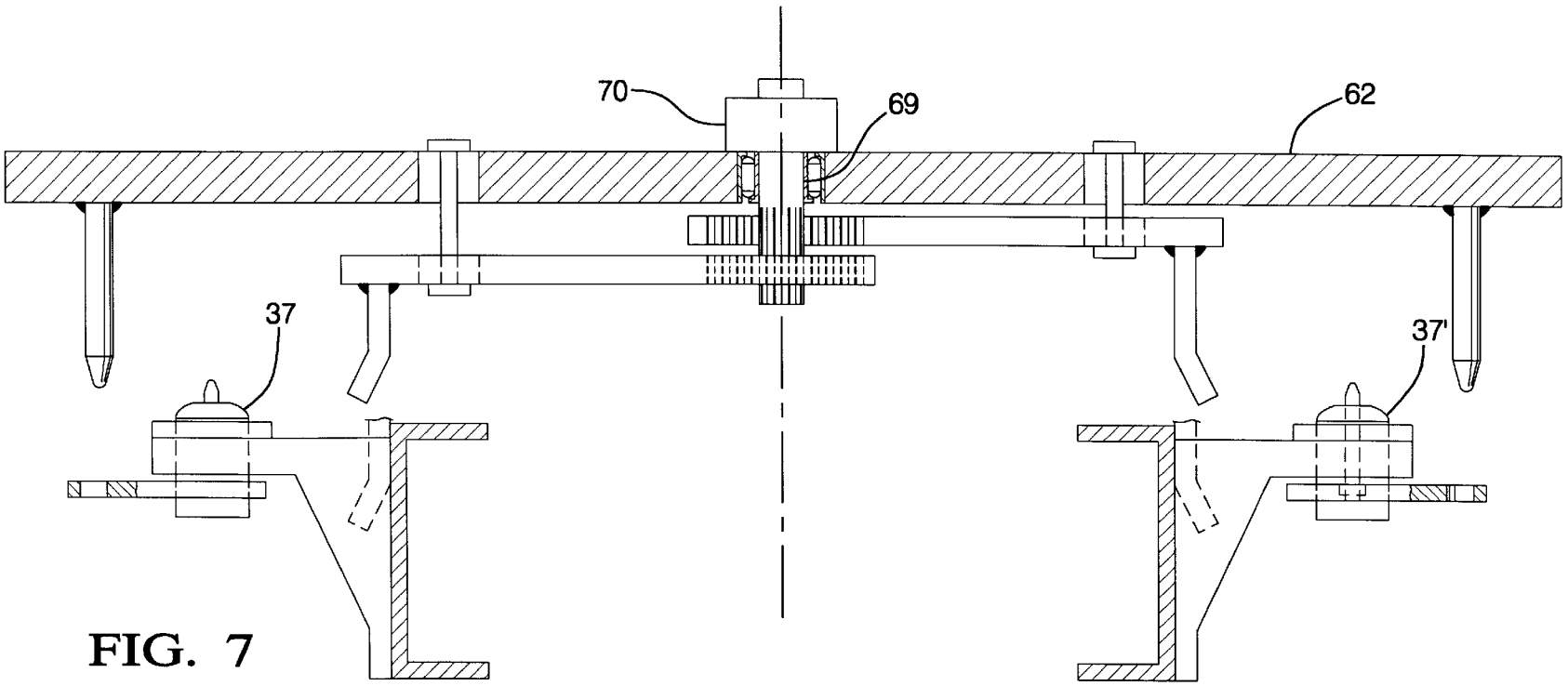
FIG. 7 is a fragmentary cross sectional view of the mount assembly system of FIG. 3 with an alternative positioning fixture shown in a pre-engagement location.
Figure 8:
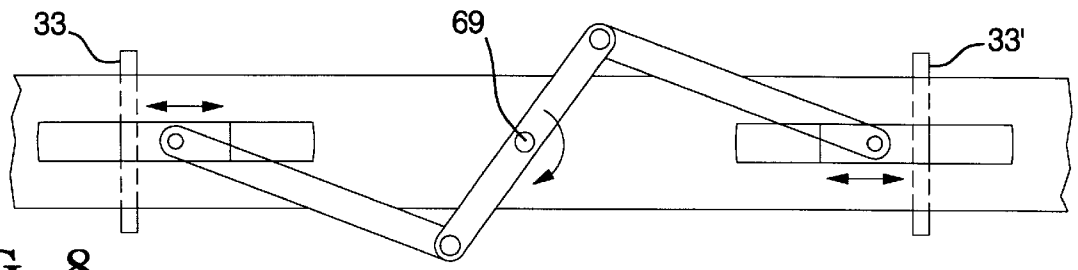
FIG. 8 is an alternative centering mechanism for the positioning fixtures of FIGS. 5–7.

FIG. 7 shows an alternative embodiment of the positioning fixture designated 62, wherein the shaft 69 is rotated by a drive unit 70 that is responsive to electronic control for centering the positioning fixture 62. This illustration also shows assembly of the mounts 37, 37' of FIG. 3, to the frame. FIG. 8 shows an alternative device for relocating the arms 33, 33' and includes a crank mechanism operated by shaft 69 to center the positioning fixture. The specific mechanism used and the drive means therefor, may be varied widely within the context of the present invention.

Thus, the invention has been described in a typical manner by referencing at least one specific embodiment of the many that are possible for providing repeatable net positioning of body mounts while avoiding part number proliferation, overcoming build-tolerance stack, and improving operator working conditions. The system of mount alignment operates to position the mount(s) onto the vehicle frame prior to the body to frame marriage operation of a vehicle assembly process and is applicable to the alignment of many types of mounts prior to assembly of two components that are mated through a mount. Bearing in mind that it has often been stated, and is generally recognized, that the claims of a patent constitute part of one of the most difficult legal instruments to draw with accuracy; the following claims define the invention and all of its possible embodiments.

What is claimed is:

1. A mount assembly system comprising:

a frame rail assembly including a platform;

a body mount initially loosely assembled to the platform by at least one fastener in a repositionable manner, and being fixed in position relative to the platform after being repositioned;

a lobe associated with the body mount and being repositionable in concert therewith, wherein the lobe includes a positioning feature; and a positioning fixture that includes a repositioning effector wherein repositioning of the body mount is effected by engagement of the repositioning effector with the positioning feature.

2. A mount assembly system according to claim 1 wherein the frame rail assembly includes a bracket attached to a frame rail wherein the platform is part of the bracket.

3. A mount assembly system according to claim 2 wherein the bracket includes a rib forming a void between the bracket and the frame rail and wherein the positioning fixture includes an arm that is extendable into the void during repositioning of the body mount.

4. A mount assembly system according to claim 1 wherein the lobe is formed as part of a plate that is initially separate from the body mount and is fixed thereto by at least one fastener prior to repositioning of the body mount, wherein the at least one fastener engages the platform and wherein the platform includes an opening that is elongated to permit repositioning of the body mount.

5. A mount assembly system according to claim 3 wherein the arm includes a tapered segment that assists in centering of the positioning fixture.

6. A mount assembly system comprising:

a first and a second frame rail, spaced apart a first distance that is within a range of predesignated distances;

a first bracket fixed to the first frame rail and having a first central opening;

a second bracket fixed to the second frame rail and having a second central opening;

a first body mount and an associated first lobe with a first positioning orifice extending through the first lobe, wherein the first lobe and the first body mount are repositionable together in concert within the first central opening prior to being fixed in position; and a second body mount and an associated second lobe with a second positioning orifice extending through the second lobe, wherein the second lobe and the second body mount are repositionable together in concert within the second central opening prior to being fixed in position;

wherein the first and second body mounts are located relative to the first and second frame rails and are spaced apart a second distance that is independent of where the first distance lies within the range of predetermined distances.

7. A mount assembly system according to claim 6 further comprising a repositioning fixture having a first pin and a second pin spaced apart a third distance that is equal to the second distance, wherein during repositioning of the body mounts, the first and second pins engage within the first and second repositioning orifices.

8. A mount assembly system according to claim 7 wherein the repositioning fixture includes a first arm and a second arm, wherein the first arm is engageable with the first frame rail and the second arm is engageable with the second frame rail during repositioning of the body mounts.

9. A mount assembly system comprising:

a frame rail;

a bracket fixed to the frame rail, the bracket including a platform with a central opening surrounded by a plurality of satellite openings;

a body mount initially loosely assembled in a repositionable manner to the platform within the central opening by a plurality of fasteners that extend through the plurality of satellite openings, and the body mount being fixable in position relative to the platform by tightening of the plurality of fasteners after the body mount is repositioned;

a lobe associated with the body mount and being repositionable in concert therewith, wherein the lobe includes a positioning orifice extending therethrough, wherein the body mount is repositionable relative to the frame rail.

* * * * *